US006715312B1

(12) United States Patent
Teakell

(10) Patent No.: US 6,715,312 B1
(45) Date of Patent: Apr. 6, 2004

(54) DE-SUPERHEATER FOR EVAPORATIVE AIR CONDITIONING

(75) Inventor: Kevin Teakell, Broken Arrow, OK (US)

(73) Assignee: AAON Inc., Tulsa, OK (US)

( * ) Notice: Subject to any disclaimer, the term of this patent is extended or adjusted under 35 U.S.C. 154(b) by 0 days.

(21) Appl. No.: 10/280,233

(22) Filed: Oct. 25, 2002

(51) Int. Cl.[7] ..... F28D 5/00; F25D 17/06
(52) U.S. Cl. ..... 62/305; 62/91
(58) Field of Search ..... 62/305, 91, 79, 62/181, 184, 238.6; 165/110, 113

(56) References Cited

U.S. PATENT DOCUMENTS

| | | | | |
|---|---|---|---|---|
| 4,311,498 A | | 1/1982 | Miller | |
| 4,796,437 A | | 1/1989 | James | |
| 5,411,078 A | * | 5/1995 | Ares | 165/113 |
| 5,692,387 A | | 12/1997 | Alsenz et al. | |
| 5,724,828 A | * | 3/1998 | Korenic | 62/305 |
| 5,816,318 A | * | 10/1998 | Carter | 165/110 |
| 6,343,479 B1 | | 2/2002 | Merritt | |
| 6,422,035 B1 | | 7/2002 | Phillippe | |
| 2001/0027664 A1 | | 10/2001 | Ross | |

* cited by examiner

*Primary Examiner*—Chen Wen Jiang
(74) *Attorney, Agent, or Firm*—Molly D. McKay

(57) ABSTRACT

An evaporative condensing air conditioning system employing a de-superheater and mist eliminator located between the air fan on an evaporative cooler and a spray tree that delivers water 20 as a coolant on the exterior surfaces of a condenser coil. The de-superheater receives superheated coolant gas from the compressor of the air conditioning system where air traveling on the outside of the de-superheater coil removes heat from the coolant gas located within the de-superheater coil to the point where the coolant is still a gas but is no longer superheated. The coolant gas then exits the de-superheater and flows into the evaporatively cooled condenser coil where the coolant is further cooled and condenses into a liquid before finishing the air conditioning circuit by consecutively moving through an optional coolant receiving chamber, a thermal expansion valve, an evaporator, and returning to the compressor.

6 Claims, 1 Drawing Sheet

DE-SUPERHEATER FOR EVAPORATIVE AIR CONDITIONING

BACKGROUND OF THE INVENTION

1. Field of the Invention

The present invention relates to an evaporative condensing air conditioning system employing a de-superheater and mist eliminator located between the air fan on an evaporative cooler and a spray tree that delivers water as a coolant on the exterior surfaces of a condenser coil. The de-superheater receives superheated coolant gas from the compressor of the air conditioning system where air traveling on the outside of the de-superheater coil removes heat from the coolant gas located within the de-superheater coil to the point where the coolant is still a gas but is no longer superheated. The coolant gas then exits the de-superheater and flows into the evaporatively cooled condenser coil where the coolant is further cooled and condenses into a liquid before finishing the normal air conditioning circuit.

2. Description of the Related Art

Currently in evaporatively cooled air conditioning units, superheated coolant gas flows from the unit's compressor directly to an evaporatively cooled condenser coil. Because the coolant gas is superheated when it enters the condenser coil, it causes the water that flows downward over the exterior surfaces of the condenser coil to be boiled off of the coil where the coolant enters the condenser coil, leaving behind mineral deposits and scale on the exterior of the condenser coil in this area that are similar to the water deposits that are formed in a tea kettle when the water in the tea kettle boils away. These deposits and scale greatly decrease the heat exchange capacity of the condenser coil and decrease the useful life of the condenser coil because the decreased cooling efficiency of the coil will eventually dictate that the coil be replaced.

The present invention addresses this problem by removing the superheat from the hot coolant gas before the gas reaches the evaporatively cooled condenser coil. More specifically, the present invention employs an air cooled de-superheater and mist eliminator located between a spray tree that delivers water to the exterior surfaces of the condenser coil and the air fan that normally pulls air through the condenser but now also pulls air through the de-superheater coil ,is a means of cooling the superheated coolant gas that flows through the de-superheater coil.

The hot coolant gas from the compressor first flows through the de-superheater where the superheat is removed from the coolant via air cooling. The coolant stream leaving the de-superheater is a saturated gas. This coolant stream enters the condenser coil at a temperature that significantly reduces the possibility of mineral build up and scaling on the exterior surfaces of the evaporatively cooled condenser coil and is further cooled in the condenser. When the coolant condenses within the condenser coil it becomes a saturated liquid. From the condenser coil, the coolant flows through the normal air conditioning circuit by consecutively moving through an optional coolant receiving chamber, a thermal expansion valve, an evaporator, and returning to the compressor.

The present invention includes a mist eliminator that is physically located between the de-superheater and the water spray tree to prevent droplets of water from reaching the de-superheater from the spray tree, thereby preventing mineral build up and scale from being deposited on the exterior surfaces of the air cooled de-superheater coil.

In reducing the amount of cooling water that turns into water vapor at the condenser and leaves the unit via the air flow through the air fan, the amount of make up water for the evaporative cooling system is reduced, thereby saving water costs. Also, with less evaporation of the cooling water, water treatment costs are also reduced because less chemical treatment is needed to keep the cooling water in balance so that it will not scale up or corrode in the cooling water circuit. The cooling water circuit consists of the spray tree, the exterior surface of the condenser coil, a water sump, and a water line that connects the water sump and the spray tree.

The present invention not only increases the efficiency and life of the condenser by preventing mineral deposits and scale from forming on the exterior surface of the condenser coil, it also increases the cooling capacity of the condenser because the condenser does not have to remove the superheat from the coolant. This makes the unit operate more efficiently.

SUMMARY OF THE INVENTION

The present invention is an evaporative condensing air conditioning system employing a de-superheater for removing the superheat from the hot coolant gas before the gas reaches the evaporatively cooled condenser coil. More specifically, the present invention employs an air cooled de-superheater and mist eliminator located between a spray tree that delivers water to the exterior surfaces of the condenser coil and an air fan that normally pulls air through the condenser, but in the present invention also pulls air through the de-superheater coil as a means of cooling the superheated coolant that flows through the de-superheater coil.

The hot coolant gas from the compressor first flows through the de-superheater where the superheat is removed from the coolant via air cooling. Then the coolant leaving the de-superheater enters the condenser coil at a temperature that significantly reduces the possibility of mineral build up and scaling on the exterior surfaces of the evaporatively cooled condenser coil. The coolant is further cooled and condenses into a liquid within the condenser coil before finishing the air conditioning circuit by consecutively moving through an optional coolant receiving chamber, a thermal expansion valve, an evaporator, and returning to the compressor.

The present invention also includes a mist eliminator that is physically provided between the de-superheater and the water spray tree to prevent stray droplets of water from reaching the de-superheater from the spray tree, thereby preventing mineral build up and scale from being deposited on the exterior surfaces of the air cooled de-superheater coil.

The cooling water circuit consists of the spray tree, the exterior surface of the condenser coil, a water sump, and a water line that connects the water sump and the spray tree.

The spray tree sprays cooling water on the exterior surface of the condenser coil. Heat from the hot coolant located within the condenser coil is transferred to the cooling water on the exterior surface of the condenser coil, causing part of the cooling water to be vaporized into the air and thereby removing the heat from the unit with the air that is pulled through the condenser, the mist eliminator and the de-superheater by the air fan. The water sump receives the cooling water that drips off of the condenser coil and the water is continuously pumped through the water line back to the spray tree from the sump. Water is replaced in the sump by a makeup water connection. The amount of makeup water is reduced by use of the de-superheater.

DETAILED DESCRIPTION OF THE PREFERRED EMBODIMENT

The Invention

Figure 1:
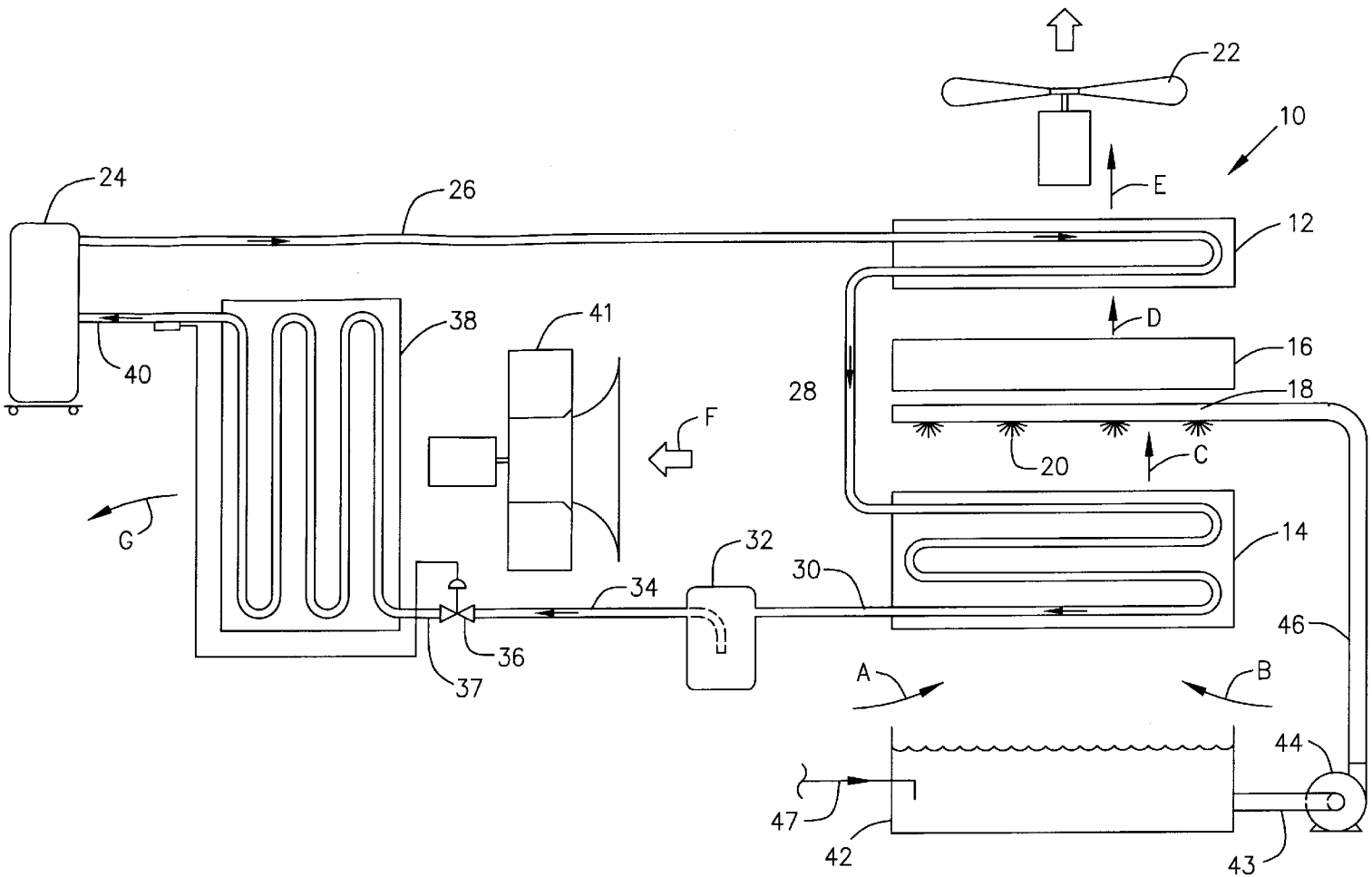
FIG. 1 is a diagram showing a de-superheater for evaporative condensing air conditioning constructed in accordance with a preferred embodiment of the present invention.

Referring now to FIG. 1, there is illustrated an evaporative condensing air conditioning system 10 employing a de-superheater 12 for removing the superheat from hot coolant gas before the gas reaches the evaporatively cooled condenser 14 constructed in accordance with a preferred embodiment of the present invention. The system 10 employs the air cooled de-superheater 12 and mist eliminator 16 that are located between a spray tree 18 that delivers cooling water 20 to the exterior surfaces of the condenser coil 14 and an air fan 22 that normally pulls air through the condenser 14, but in the present invention also pulls air through the mist eliminator 16 and the de-superheater coil 12 as a means of cooling the superheated coolant that flows through the de-superheater coil 12.

Superheated hot coolant gas from a compressor 24 first flows through coolant line 26 to the de-superheater 12 where the superheat is removed from the coolant via air cooling. Then the coolant leaving the de-superheater 12 travels via coolant line 28 to the condenser 14, entering the condenser coil 14 as a saturated gas and at a temperature that does not promote mineral build up and scaling on the exterior surfaces of the evaporatively cooled condenser coil 14. The coolant is further cooled and condenses into a liquid within the condenser coil 14 before finishing the air conditioning circuit by consecutively moving through a coolant line 30 to an optional coolant receiving chamber 32, through another coolant line 34 to a thermal expansion valve 36, through still another coolant line 37 to an evaporator 38, through the evaporator 38, and returning to the compressor 24 via still another coolant line 40. Although the air conditioning circuit is described as having a coolant receiving chamber 32, the feature is optional. As shown in the drawing by arrows F and G, an air handling fan 41 forces air to be cooled over the chilled exterior surfaces of the evaporator coil 38 in order to provide cool air for use in a building. Although the air handling fan 41 is shown in the drawing as being located upstream of the evaporator 38 so that it pushes air through the evaporator 38, it could also be located downstream of the evaporator 38 so that it pulls air through the evaporator 38.

The present invention also includes a mist eliminator 16 that is physically provided between the de-superheater 12 and the water spray tree 18 to prevent stray droplets of water 20 from reaching the de-superheater 12 from the spray tree 18, thereby preventing mineral build up and scale from being deposited on the exterior surfaces of the air cooled de-superheater coil 12.

The cooling water circuit consists of the spray tree 18, the exterior surfaces of the condenser coil 14, a water sump 42, a water line 43 that connects the water sump 42, and a water pump 44 that continuously pumps cooling water 20 via a water line 46 from the water sump 42 to the spray tree 18. Water 20 is replaced in the sump 42 by a makeup water connection 47. The amount of makeup water is reduced by use of the de-superheater 12.

The spray tree 18 sprays cooling water 20 on the exterior surface of the condenser coil 14. Heat from the hot coolant located within the condenser coil 14 is transferred to the cooling water 20 on the exterior surface of the condenser coil 14, causing part of the cooling water 20 to be vaporized into the air and thereby removing the heat from the unit 10 with the air that is pulled by the air fan 22 through the air circuit of the evaporative cooler, i.e. through the condenser 14, then through the mist eliminator 16, and finally through the de-superheater 12, as shown by arrows A, B, C, D, and E. The water sump 42 receives the cooling water 20 that drips off of the condenser coil 14, and the water pump 44 continuously pumps cooling water 20 through the water line 46 back to the spray tree 18 from the sump 42.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A de-superheater for an evaporative condensing air conditioning system comprising:

an air cooled de-superheater coil, said de-superheater coil connected to and receiving superheated coolant gas from a compressor of an evaporative condensing air conditioning system, and said de-superheater coil provided with one connection to and supplying completely de-superheated coolant gas to an evaporatively cooled condenser coil of the evaporative condensing air conditioning system.

2. A de-superheater for an evaporative condensing air conditioning system according to claim 1 further comprising:

a mist eliminator located between the de-superheater coil and a spray tree of the evaporative condensing air conditioning system to prevent water droplets from the spray tree from reaching the de-superheater coil.

3. An evaporative condensing air conditioning system with de-superheater according to claim 1 further comprising:

said condenser coil connected to and supplying liquid coolant gas to a thermal expansion valve, said thermal expansion valve connected to and supplying coolant gas to an evaporator, and said evaporator connected to and supplying coolant gas to said compressor.

4. An evaporative condensing air conditioning system with de-superheater according to claim 3 further comprising:

a mist eliminator located between the de-superheater coil and a spray tree of the evaporative condensing air conditioning system to prevent water droplets from the spray tree from reaching the de-superheater coil.

5. An evaporative condensing air conditioning system with de-superheater according to claim 1 further comprising:

a common air supply passing through both the evaporatively cooled condenser coil and the de-superheater coil.

6. An evaporative condensing air conditioning system with de-superheater according to claim 5 further comprising:

a mist eliminator located between the de-superheater coil and a spray tree of the evaporative condensing air conditioning system to prevent water droplets from the spray tree from reaching the de-superheater coil.

* * * * *